US005704305A

United States Patent [19]

Winter

[11] Patent Number: 5,704,305

[45] Date of Patent: Jan. 6, 1998

[54] WIND SAILING VESSEL

[75] Inventor: Steve Winter, Oxnard, Calif.

[73] Assignee: Catsurfer, Inc., Ventura, Calif.

[21] Appl. No.: 585,449

[22] Filed: Jan. 16, 1996

[51] Int. Cl.[6] ..... B63B 35/00

[52] U.S. Cl. ..... 114/39.1; 114/39.2; 114/61

[58] Field of Search ..... 114/39.1, 39.2, 114/61, 123, 274

[56] References Cited

U.S. PATENT DOCUMENTS

| | | | |
|---|---|---|---|
| 2,577,917 | 12/1951 | Root . | |
| 3,016,859 | 1/1962 | Johnson . | |
| 3,273,528 | 9/1966 | Kiefer | 114/39.1 |
| 3,455,261 | 7/1969 | Perrin . | |
| 3,742,886 | 7/1973 | Dillon . | |
| 3,841,251 | 10/1974 | Larson | 114/39.1 |
| 4,159,689 | 7/1979 | Odoj . | |
| 4,401,047 | 8/1983 | Auras . | |
| 4,437,424 | 3/1984 | Lord . | |
| 4,530,299 | 7/1985 | Ross . | |
| 4,537,145 | 8/1985 | White . | |
| 4,715,306 | 12/1987 | Horais . | |
| 5,024,177 | 6/1991 | Winter . | |

FOREIGN PATENT DOCUMENTS

| | | |
|---|---|---|
| 014835 | 7/1981 | France . |
| 3230795A1 | 2/1984 | Germany . |
| 3341996A1 | 5/1985 | Germany . |

*Primary Examiner*—Stephen Avila
*Attorney, Agent, or Firm*—Cislo & Thomas

[57] ABSTRACT

A wind sailing vessel for sailing over a water surface comprising an arch shaped platform which disengageably engages first and second conventional windsurfing devices in a spaced, side-by-side relationship. The arch shaped platform further comprises two centerboards centrally located on the platform bottom surface between the windsurfing devices for providing maneuverability. The arch shaped platform can be disengaged from the windsurfing devices, allowing each of the devices to be sailed separately as a typical windsurfing vessel. Affixed to the bottom surface of the platform are a plurality of fastening plates allowing for different degrees of inclination or balance during attachment to accommodate the top surfaces of the windsurfing devices. The two centerboards of the arch shaped platform each define an aperture for engageably receiving an axle wheel combination used to transport the wind sailing vessel to and from the water.

23 Claims, 6 Drawing Sheets

WIND SAILING VESSEL

BACKGROUND OF THE INVENTION

This invention relates generally to Windsurfing-type, or sailboard sailing vessels, more particularly to sailing vessels utilizing a catamaran configuration, particularly suitable for sailing over large bodies of water.

Popularity of Windsurfing-type vessels have grown immensely popular in recent years. The typical Windsurfing-type sailing vessel comprises a conventional surfboard generally between eight and twelve feet in length with a mast and sail somewhere in the range of around thirteen to sixteen feet in length. Furthermore, vessels such as these allow for the speedy sailing as well as the riding of any encountered surf. However, a high degree of balance and agility is required with many windsurfing-type vessels or wind surfers. Also, steering and turning is extremely difficult to the novice.

The operator of the Windsurfing-type sailing vessel must balance upon the windsurfing board while holding and directing a fairly large sized sail so as to propel the vessel, as well as, steer the vessel. Great degrees of muscle coordination and balance must be developed by practicing extensively until adequate skills are developed to enjoy all the benefits of windsurfing. Often times, many prospective windsurfing enthusiasts or novices unsuccessfully attempt to master the muscle coordination and balance and become disillusioned with the sport. They eventually forego the joys of windsurfing because the commitment of time to develop those skills is far too great. This is especially true for the very young or older person who has neither the time nor the coordination to properly sail a conventional windsurfing vessel.

A number of devices have been developed over the years in an attempt to lessen the balance and coordination requirements for sailing a small wind propelled surfing vessel. Some related patents are described below:

U.S. Pat. No. 2,577,917 issued to H. L. Root on Dec 11, 1951

This patent describes a vessel having a pair of pontoons that receive the feet of a user to permit the user to walk or float on the surface of water. A sail can be held to propel the pontoons. A frame member can be operatively associated between the pontoons for seating.

U.S. Pat. No. 3,455,261 issued to H. Perrin on Jul. 15, 1969

This patent describes a board having a concave undersurface with projecting lateral legs which extend into the water. The sail is used to provide wind propulsion.

U.S. Pat. No. 3,742,886 issued to J. N. Dillon on Jul. 3, 1973

This patent describes a pontooned water craft comprising of two pontoons which are connected together by a parallelogram linkage. The operator of the craft stands upon the linkage carrying a hand sail and steers the craft with a movable rudder affixed to the linkage.

U.S. Pat No. 4,159,689 issued to G. Odoj on Jul. 3, 1979

This patent describes a single board-like floating body to be used with a connecting sail. A rigid plate is affixed to the board which projects into the water.

U.S. Pat. No. 4,437,424 issued to D. W. Lord on Mar. 20, 1984

This patent describes a wind propelled boat of the sail board type having two pontoons which cut into the water and are connected by a rigid arched member which retains a movable centerboard.

U.S. Pat. No. 4,530,299 issued to A. Ross on Jul. 23, 1985

This patent describes a wind propelled surfboard which has a catamaran hull wherein each hull can be folded to a collapsed position. Each hull is very narrow for portability and a centerboard is not incorporated.

U.S. Pat. No. 4,537,145 issued to C. R. White on Aug. 27, 1985

This patent describes an elongated main hull and a shorter elongated float. Both are secured in a parallel relationship with cross beams. A centerboard is not incorporated and a sail is used which is movably affixed to the main hull.

U.S. Pat No. 4,715,306 issued to A. W. Horais in December 1987

This patent describes a catamaran with a steerable centerboard apparatus wherein the centerboard is pivotally mounted. The catamaran is constructed by a pair of parallel hulls which are held in parallel fashion by a deck portion.

Each of the references above attempt to provide a personal sailing vessel which allows for speed, steerability and stability. However, the versatility of each of the disclosed references does not allow for the same exalted speed and maneuverability of a conventional single board Windsurfing device. Furthermore, the twin pontoons or hulls of the disclosed vessels provide for difficulty in maneuvering, particularly, turning. Like most catamaran type vessels, turning is difficult because two parallel hulls are cutting the water simultaneously. The hull on the side opposite the side of the turn tries to continue on a straight course-slowing the turn. A great degree of stress between the two hulls is transferred to the interconnecting deck. The fluid dynamics around each hull prevent quick turns. Quick turns are only possible when the craft is keeling hard to one side or the other, lifting one hull out of the water. However, this is a very unstable condition.

It is extremely desirable that a Windsurfing-type vessel has the stability and the ease of sailing of some of the above-described vessels, yet have the same maneuverability and speed as a conventional single board Windsurfing-type device. Also, it is desirable to have such a device having the versatility to be used in association with conventional windsurfing devices with a minimum amount of disassembly and also being easily transportable to and from the water.

The features identified above as being desirable for a wind sailing vessel are all provided by the present invention.

SUMMARY OF THE INVENTION

A wind sailing vessel for mounting on the upper surface of conventional windsurfing boards, or the like, as set forth in the present invention comprises an upraised platform that arches between two windsurfing boards spaced in a side-by-side relationship for sailing over a water surface. The upraised platform provides an upper surface for a sailor or sailors to stand and two centerboards or keels on a bottom surface used for providing sailing maneuverability.

Affixed to the bottom surface of the upraised platform are a set of forward and aft plate members which allow the platform to be attached to the footstrap and mast inserts located along the top surface of conventional windsurfing boards.

The plate members define a plurality of apertures which provide for the platform to be fastened at various points along the length of the windsurfing boards which may have a curved contact surface. By fastening the plate members to different points along the windsurfing boards, an angled configuration or balanced position between platform and boards can be obtained for greater performance of the sailing vessel.

For transportation purposes, the two centerboards which are centrally located on the platform's bottom surface each define an aperture which engageably receives the ends of an axle wheel combination thereby allowing the wind sailing vessel to be moved to and from the water.

For added mobility, the fins located at the rear bottom surface of each windsurfing board may additionally define an aperture to engageably receive the ends of a second axle wheel combination for use in association with the platform's axle wheel combination thereby improving the transportability of the wind sailing vessel.

An object of the present invention is to provide for a greatly stabilized Windsurfing-type craft that allows for greater ease and turning ability, yet requires little balance, coordination and muscular agility.

Another object is to provide a wind sailing vessel which is compact and completely portable for purposes of transportation and storage.

A further object is to provide a wind sailing vessel which is easy to assemble, as well as, disassemble and easy to manufacture.

Still another object is to provide a wind sailing vessel that allows even the most inexperienced novice in windsurfing to thoroughly enjoy all of the advantages that trained and well-practiced windsurfing sailors have enjoyed heretofore.

Other aspects and advantages of the present invention will become apparent from the following description of the preferred embodiment, taken in conjunction with accompanying drawings, which illustrate, by way of example, the principles of the invention.

BRIEF DESCRIPTION OF THE DRAWINGS

The above, as well as other, advantages of the present invention will become readily apparent to those skilled in the art from the following detailed descriptions of the preferred embodiment when considered in light of the accompanying drawings in which.

DESCRIPTION OF THE PREFERRED EMBODIMENTS

Figure 1:
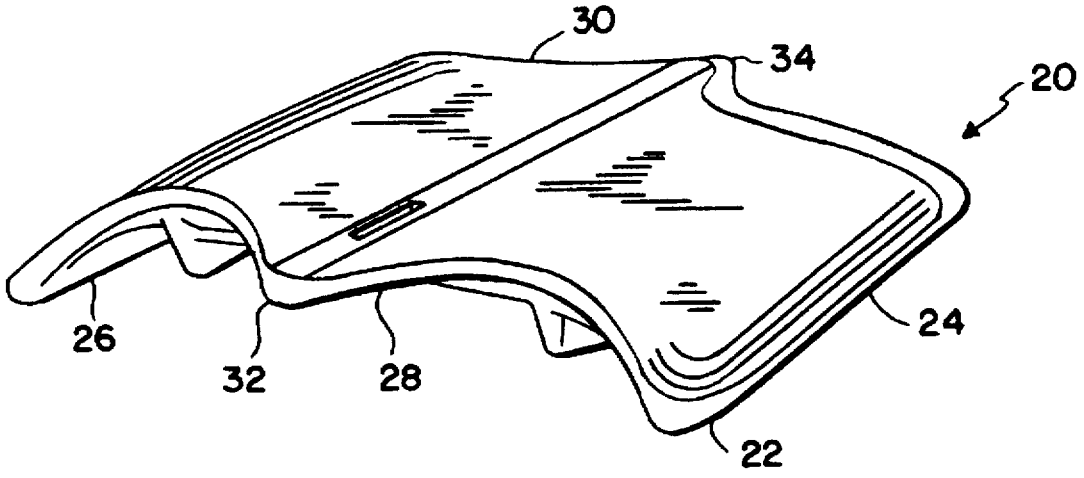
FIG. 1 is a perspective view of the wind sailing vessel in accordance with the present invention.

Referring now to the drawings wherein like reference numerals refer to like and corresponding parts throughout, the wind sailing vessel of the present invention is indicated by numeral 20. Referring now to FIG. 1, the wind sailing vessel 20 is comprised of an upraised platform 22 having straight rails 24 and 26 defining the sides of the wind sailing vessel 20 thereof. The wind sailing vessel 20 further defines front and rear portions 28 and 30, each defining elongated nose portions 32 and 34.

The wind sailing vessel 20 according to the present invention can be formed of a buoyant material, preferably a fiber glass shell with a buoyant foam within as commonly used in the art of surfboard and Windsurfing board manufacture. The type of material and construction methods are commonly known in the art of surf board and Windsurfing board manufacture. Furthermore, the vessel 20 may be decorated or painted pursuant to the likes of its owner. The vessel 20 can be fabricated to different lengths with the preferred length being four (4) feet long.

Figure 2:
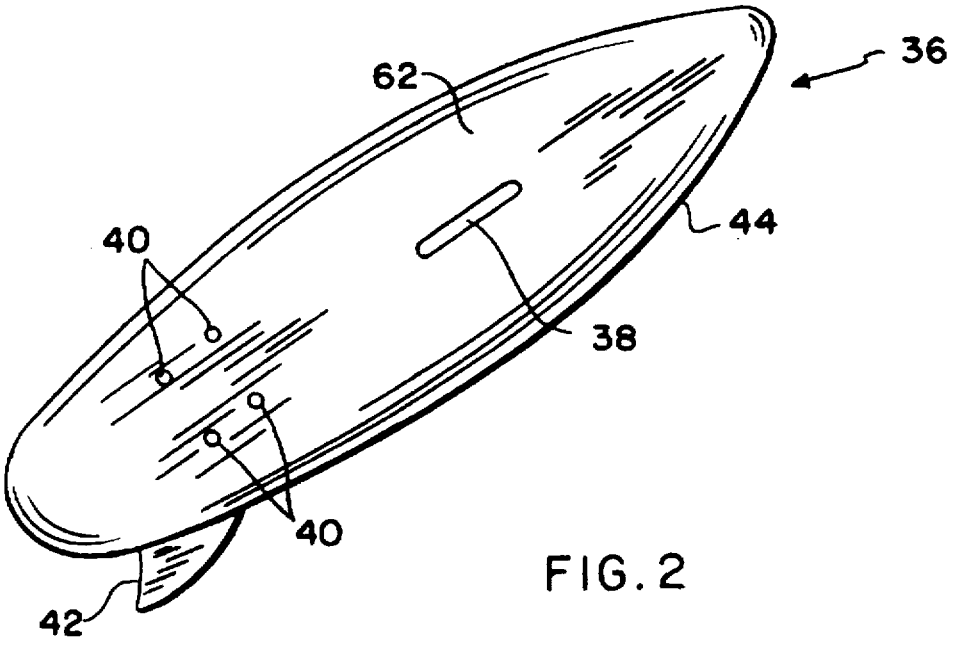
FIG. 2 is a perspective view of a conventional single board windsurfing device.

FIG. 2 shows a conventional single board windsurfing device 36 which is used in association with the wind sailing vessel 20 of FIG. 1, as will be more fully described below. The Windsurfing device 36 is similarly constructed as the wind sailing vessel 20 being formed of a buoyant material preferably a fiber glass shell with a buoyant foam within, as is commonly used in the art of Windsurfing board manufacture.

A keel or fin 42 is attached and located at an aft end on the undersurface 44 of the Windsurfing board 36. The fin 42 provides for greater directional stability when sailing the vessel 20 over the surface of the water as will be more fully described below.

As shown in FIG. 2 located at the center of the top surface 62 of Windsurfing device 36 is a mast track insert 38 for receiving and securing a windsurfing mast and sail (not shown) commonly used in the sport of Windsurfing. Near the rear of the Windsurfing board 36 along the top surface 62 are a plurality of strap inserts 40 which receive and secure footstraps also commonly used in the sport of Windsurfing.

Figure 3:
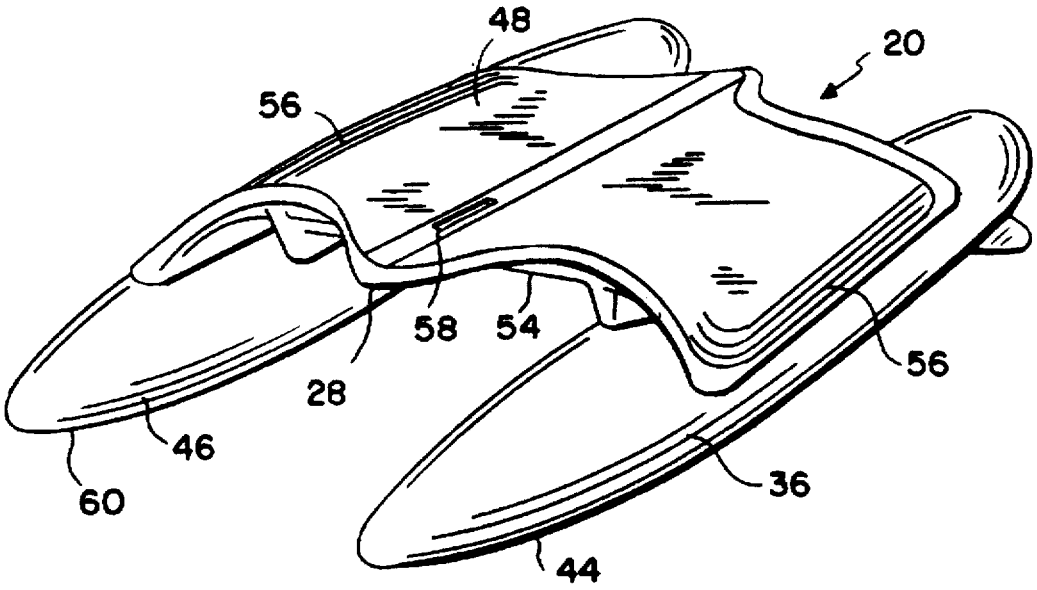
FIG. 3 is a perspective view of the wind sailing vessel of FIG. 1 mounted to two windsurfing devices of FIG. 2.
Figure 4:
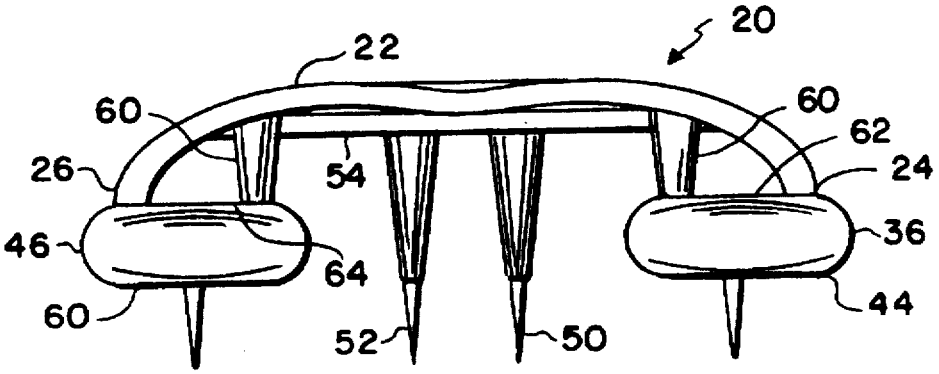
FIG. 4 is a front elevational view of the combination shown in FIG. 3.

Referring now to FIGS. 3 and 4, the Windsurfing vessel 20 is shown mounted to the Windsurfing device 36 shown in FIG. 2 and a second Windsurfing device 46 having an undersurface 60 which is identical or very similar to the first Windsurfing device 36. However, slight variation between the Windsurfing devices 36 and 46 might be tolerated and should not affect the performance of the wind sailing vessel 20 substantially. In the preferred embodiment, the planar undersurfaces 44 and 60 of both Windsurfing devices 36 and 46, respectively, are sufficient to provide a surfing action when encountering waves and rough water.

The upraised platform 22 of wind sailing vessel 20 arches between the Windsurfing boards 36 and 46 spaced in a side-by-side relationship for sailing over a water surface. The wind sailing vessel 20 provides an upper surface 48 for a sailor or sailors to stand and two (2) centerboards or keels 50 and 52 centrally located on the platform's 22 bottom surface 54 used for providing greater directional stability when sailing the vessel 20 over the surface of the water.

In the preferred embodiment the upper surface 48 of wind sailing vessel 20 comprises strips 56 of neoprene or like material (not shown) which can be used to increase the coefficient of friction between the sailor's feet and the platform 22 to prevent slipping when operating the wind sailing vessel 20. Additionally, the Windsurfing devices 36 and 46 in the preferred embodiment should have a mean thickness of approximately three (3) to five (5) inches depending upon certain performance criteria. With a thicker cross section of buoyant material within the Windsurfing devices 36 and 46, persons of heavier weight or more than one person can sail the vessel 20 without submerging the Windsurfing devices 36 and 46, which can make getting started difficult.

Referring now to FIG. 3, centrally located on the front portion 28 of upper surface 48 is a recessed region 58 for associated hardware (not shown) for engaging a bottom end of a mast (not shown) of a conventional sail. The recessed region 58 and associated hardware, as well as the design of the bottom end of the mast are of a conventional type normally used with Windsurfing type devices well known in the art. Normally such devices include a ball and socket configuration so as to allow the mast to rotate in a number of different planes for providing steering capability and minimizing the force of wind to propel the vessel 20 depending upon wind direction.

In the preferred embodiment of the invention, as shown in FIG. 4, the centerboards 50 and 52 which project downwardly from the undersurface 54 of the platform 22 are in parallel relationship to the first Windsurfing device 36 and the second Windsurfing device 46, being retained there between. The centerboards 50 and 52 are perpendicular to undersurfaces 44 and 60 of the Windsurfing devices 36 and 46, respectively, and serves as a stabilizing keel means. The centerboards 50 and 52 have a length and geometric shape so as to extend below a plane defined by the undersurfaces 44 and 60 of the first Windsurfing devices 36 and 46 respectively. Thus, the centerboards 50 and 52 are normally extended below the surface of the water (not shown) which is to be sailed upon.

Figure 5:
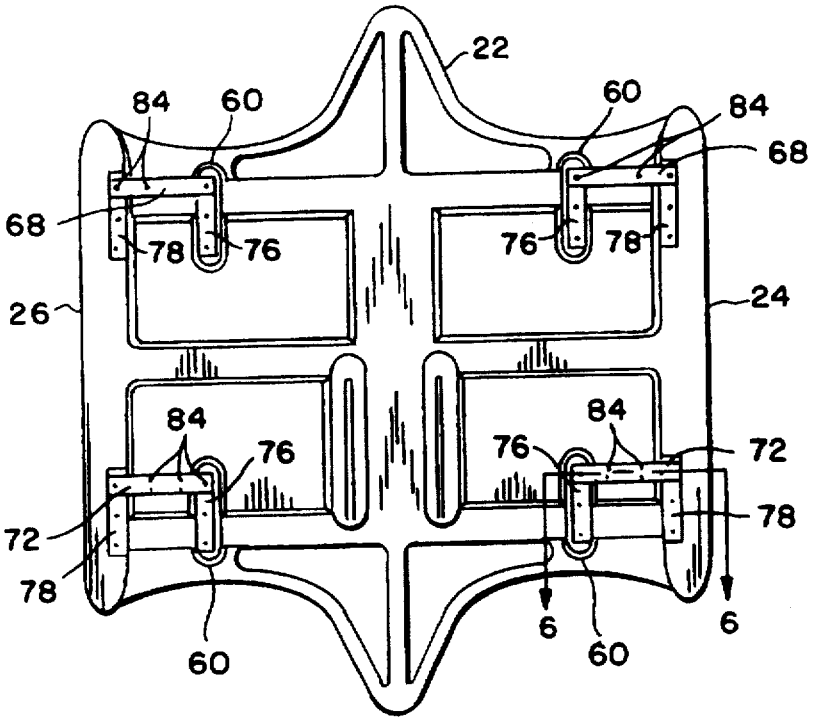
FIG. 5 is a bottom plan view of the wind sailing vessel of FIG. 1.

As shown in FIG. 5, the bottom surface 54 of platform 22 defines longitudinal legs 60 located inboard at each corner from the rails 24 and 26. The length of each leg 60 is uniform and extends to a plane defined by the bottom of the elongated rails 24 and 26 as shown in FIG. 6.

The legs 60, extend a vertical length so as to engage the top surfaces 62 and 64 of Windsurfing devices 36 and 46, respectively, as shown in FIG. 4. The longitudinal length of the legs 60 may fully extend along the length of rails 24 and 26. However, in the preferred embodiment the legs extend only a quarter of the longitudinal length of each rail 24 and 26 respectively. The width of the legs 60 are sufficient so as to support the platform 22 while engaging the Windsurfing devices 36 and 46 respectively. This unique arrangement provides for a two point balance engagement between each of the two Windsurfing devices 36 and 46, respectively, and the platform 22.

Figure 6:
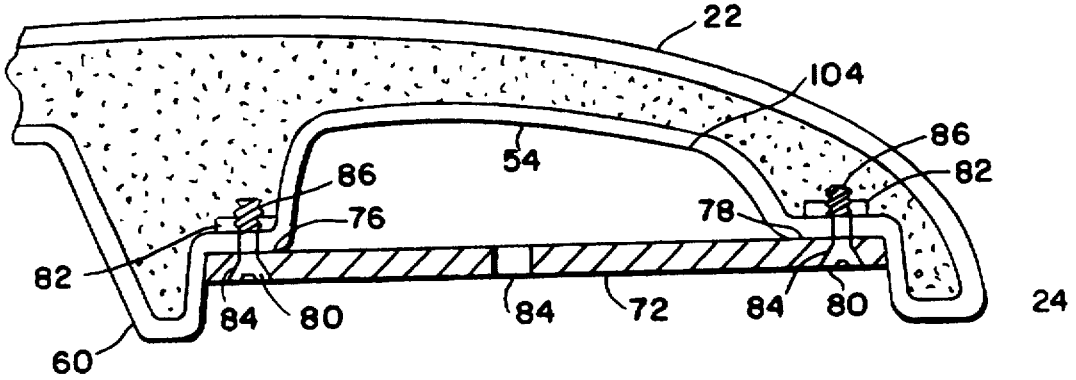
FIG. 6 is a partial cross-sectional front elevational view, taken along the line 6—6 of FIG. 5 showing a forward plate member of the present invention.

As shown in FIGS. 5 and 6 the longitudinal legs 60, each define leg recess portions 76 facing outwardly toward the rails 24 and 26. The rails 24 and 26 define rail recess portions 78 along the inboard side that are complimentary to the leg recess portions 76 of longitudinal legs 60. Forward and aft plate members 68 and 72 are laterally connected at each corner between the outside rail recess portion 78 and each inboard leg recess portion 76.

As shown in FIG. 6, the forward plate members 68 are permanently affixed to the bottom surface 54 of platform 22 by use of plate member fastening screws 80. As shown in FIG. 5, a plurality of apertures 84 are located along forward plate members 68, thereby providing a variety of fastening locations for receiving the plate member fastening screws 80 and for use in mounting the platform 22 to windsurfing devices 36 and 46 respectively, as will be more fully described below. The plate member fastening screws 80 define threaded ends 86 and attach the forward plate members 68 to the leg and rail recess portions 76 and 86 by engaging platform threaded insert portions 82 located interiorly within platform 22.

Figure 7:
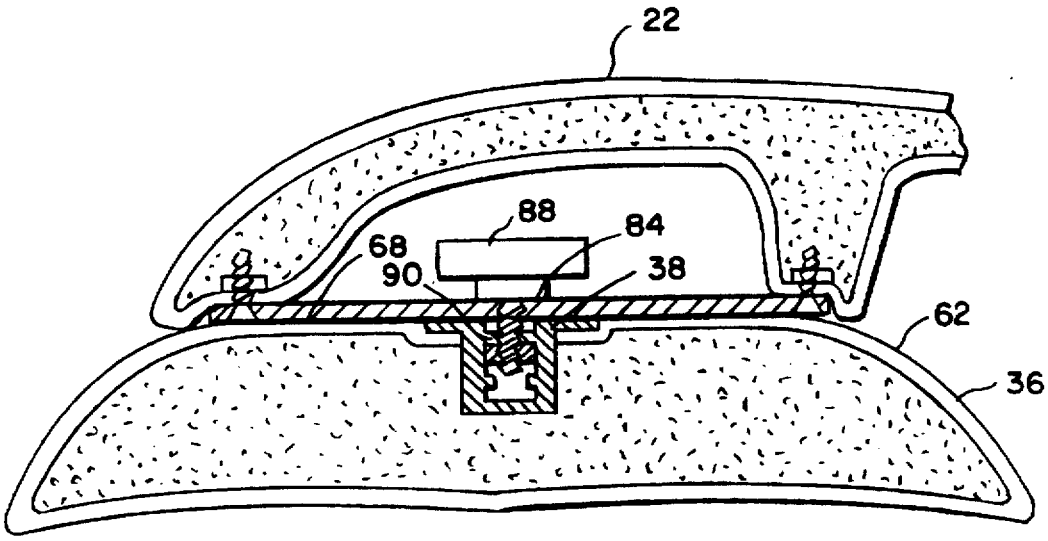
FIG. 7 is a partial cross-sectional front elevational view showing the mounting of the forward plate member to the windsurfing device shown in FIG. 2.

As shown in FIG. 7, the front portion 28 of the platform 22 is mounted to Windsurfing device 36 by aligning the aperture 84 of forward plate member 68 to coincide with mast inserts 38. A thumb screw 88 having threaded end 90 engages the threaded mast insert 38 correspondingly positioned within the first Windsurfing device 36. By turning the thumbscrew 88, in a clockwise direction, the forward plate member 68 is securely tightened against the top surface 62 of Windsurfing device 36. Although not shown, it may be envisioned that the second Windsurfing device 46 is secured to the opposite side of platform 22 by the same procedure.

Figure 8:
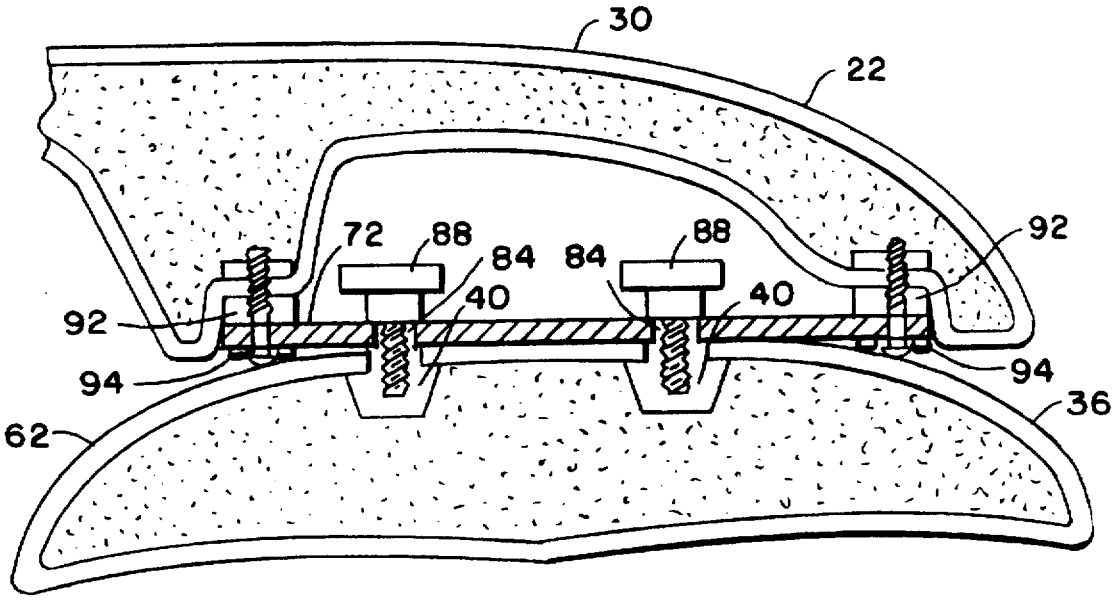
FIG. 8 is a partial cross-sectional back view illustrating the mounting of the aft plate member to the windsurfing device shown in FIG. 2.

As shown in FIG. 8, the rear portion 30 of the platform 22, is mounted to the top surface 62 of Windsurfing device 36, by utilizing the footstrap inserts 40 located at the rear of the Windsurfing device 36. The platform 22 is fastened to the top surface 62 of Windsurfing device 36 by aligning apertures 84 of aft plate member 72 to coincide with the footstrap inserts 40. Once again, fastening thumbscrews 88 having threaded ends 90 are placed through the apertures 84 and engageably received within the threaded footstrap inserts 40. The footstrap inserts 40 by providing receiving points for the threaded ends 90 of fastening thumb screws 88, securely retain the rear portion 30 of the platform 22 to the top surface 62 of Windsurfing device 36. Additionally, stand offs 92 are provided to shim the aft plate member 72 as needed depending on the curvature of the Windsurfing board and the location of the apertures 84 and footstrap inserts 40. A rubber spacer 94 is located between the head of aft plate member 72 and fastening screw 80 to spread the load between aft plate member 72 and the top surface 62 of Windsurfing device 36 thereby providing additional adjustability depending on the Windsurfing device in use. Although not shown, it may be envisioned that the second Windsurfing device 46 is secured to the opposite side of platform 22 by the same procedure.

As described above and shown in FIGS. 7 and 8, the threaded mast and footstrap inserts 38 and 40, provide the receiving points for the threaded ends 90 of the fastening thumb screws 88, thereby securely retaining both the front section 30 and the rear section 28 of platform 22 to the first and second Windsurfing devices 36 and 46 respectively. Furthermore, the mast and footstrap inserts 38 and 40 are sufficiently secured within the interior of the Windsurfing devices 36 and 46, respectively, so as not to pull free under the expected stresses and strains of sailing the wind sailing vessel 20 in rough water with high waves or in high wind conditions.

Alternatively, more than one fastening thumb screw 88 can be used along the length of each of the forward and aft plate members 68 and 72, respectively, of platform 22, thereby providing additional complimenting apertures (not shown) for use in aligning platform 22 to the Windsurfing devices 36 and 46 respectively. However, in the preferred embodiment only two (2) fastening thumb screws 88 are used with the footstrap inserts 40 and one (1) fastening thumb screw 88 is used with the mast insert 38 to retain the platform 22 to the top surfaces 62 and 64 of Windsurfing devices 36 and 46 respectively. Typically, in conventional Windsurfing devices, a number of different threaded footstep inserts 40 are variably positioned along the length of the Windsurfing devices 36 and 46 which allow for adjustability when mounting platform 22, thereby providing varied sailing performance by varying the angle or balance between the Windsurfing devices 36 and 46 with respect to the platform 22.

Figure 9:
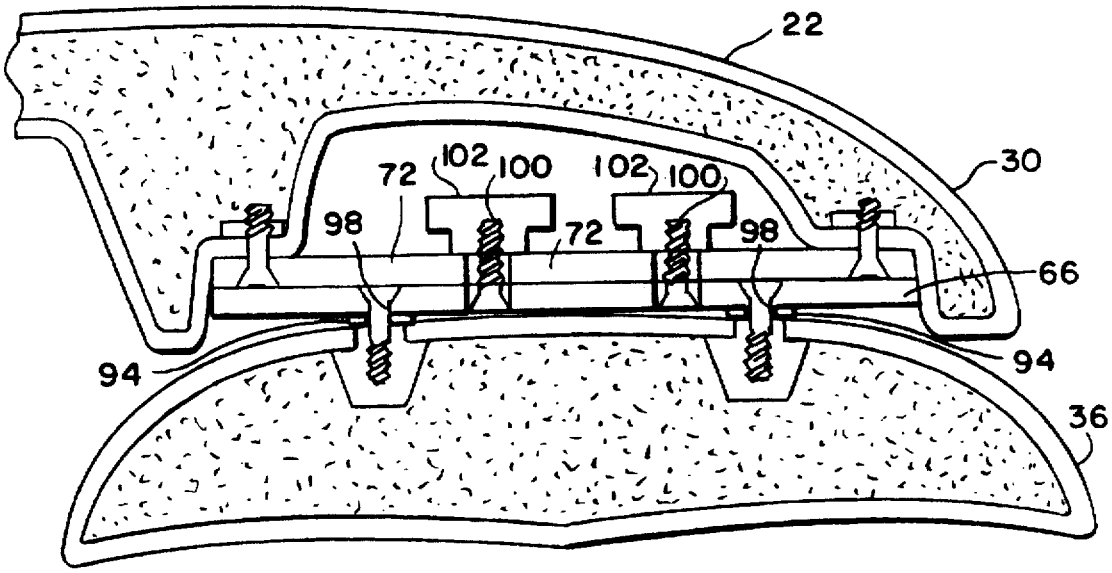
FIG. 9 is a partial cross-sectional back view illustrating another embodiment of mounting the aft plate member to the windsurfing device shown in FIG. 2.

An alternate embodiment for mounting the rear portion 30 of platform 22 to Windsurfing device 36 is shown in FIG. 9. A second plate member 66 engages the top surface 62 of Windsurfing device 36 by use of attachment screws 98 which securely retain the plate member 66 to the top surface 62 of Windsurfing device 36. As described in the preferred embodiment, the fastening screws 98 are threaded into the footstrap inserts 40 and a rubber spacer 94 is utilized between plate member 66 and the top surface 62 of Windsurfing device 36 to spread the load and provide additional adjustability depending on the Windsurfing device in use. Next, a plurality of second fastening screws 100 are received through second plate member 66 and through the apertures 84 of aft plate member 72. Threaded thumb screws 102 are now threaded on fastening screws 100, thereby securing aft plate member 72 to plate member 66, thereby retaining platform 22 to Windsurfing device 36. Similarly, although not shown it may be envisioned that aft plate member 72 on the opposite side of platform 22 mounts the second Windsurfing device 46 in the same fashion. By using plate member 66, additional support is added to the rear portion 30 of platform 22, thereby providing greater support during high wave conditions.

Even though it has been described that the platform 22 can be fastened to various points along each of the Windsurfing devices 36 and 46, by use of additional apertures 84 in the forward and aft plate members 68 and 72, respectively, it should be noted that this adjustability allows the possibility for slight inclination of the first Windsurfing device 36 and the second Windsurfing device 46 with respect to the surface of the water when sailing, and provides a hydroplaning contact with the surface of the water.

Also, as shown in FIG. 6, the undersurface 54 of platform 22 defines arches 104 between longitudinal legs 60 and rails 24 and 26 to allow the free flow of water on either side of the platform 22 during sailing. This prevents the possibility of water build up between the platform 22 and the Windsurfing devices 36 and 46, respectively. In the preferred embodiment, the platform 22 sufficiently arches above the first Windsurfing device 36 and second Windsurfing device 46 so as to provide a distance of at least six inches above both Windsurfing devices 36 and 46. This configuration reduces the possibility of the platform 22 hitting waves over the course of sailing the wind sailing vessel 20 in rough water.

Figure 10:
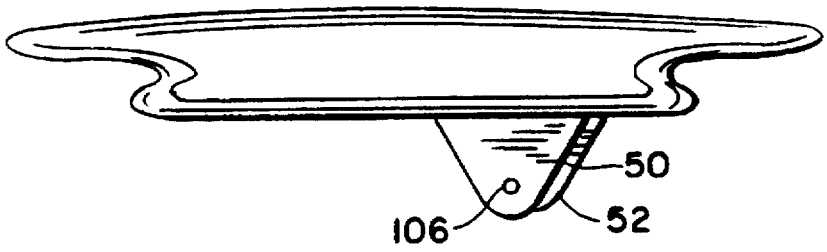
FIG. 10 is a side elevational view of the wind sailing vessel of FIG. 1.
Figure 11:
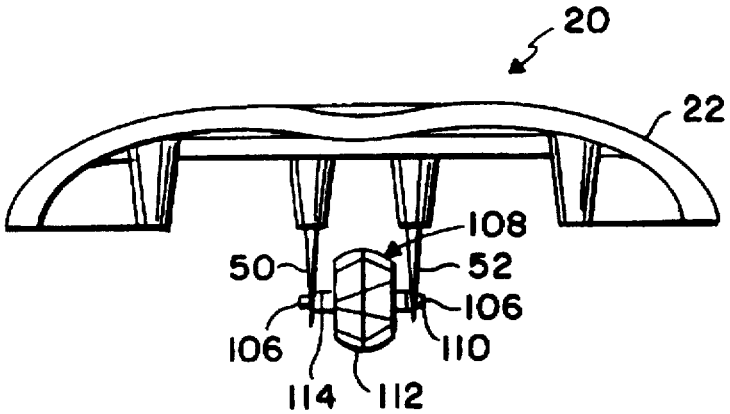
FIG. 11 is a front elevational view of the wind sailing vessel of FIG. 1 mounted to an axle wheel combination.

As shown in FIG. 10, the center boards or keels 50 and 52 define apertures 106 for engageably receiving an axle wheel combination 108, shown in FIG. 11, for use in transporting the wind sailing vessel 20 to and from the water. The axle wheel combination 108 comprises an axle 110 sized to be received through apertures 106 having a wheel 112 located on the center of axle 110 and held in place by collars 114 on each side of wheel 112 and abutting against fins 50 and 52. The axle wheel combination 108 is attached to the platform 22 by springing the fins 50 and 52 apart and slipping in the axle 108. The platform 22 can now be rolled in an upright position to any desired location.

Figure 12:
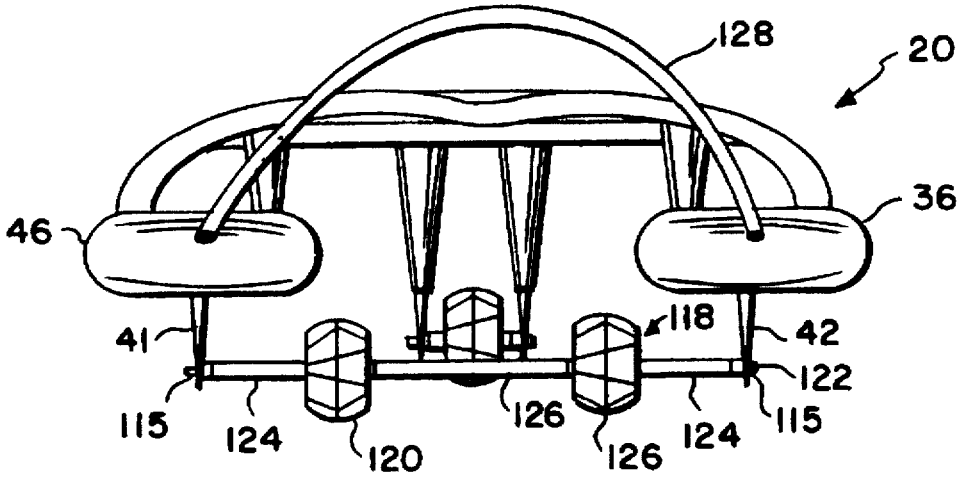
FIG. 12 is a front elevational view of the combination shown in FIG. 3 mounted to a set of axle wheel combinations.

Additionally, for added mobility of the wind sailing vessel 20 when mounted to the Windsurfing devices 36 and 46, respectively, the Windsurfing devices 36 and 46 having fins 41 and 42 may similarly define apertures 115 for receiving a second axle wheel combination 118 as shown in FIG. 12. The axle wheel combination 118 comprises of wheels 120, axle 122, outside collars 124 and an inside collar 126. In use, the axle wheel combination 118 is attached to Windsurfing devices 36 and 46 by spreading apart fins 41 and 42 until the axle 122 fits through apertures 115 on each end, thereby springing back against collars 124 which retain wheels 120 against an inside collar 126. Additionally, a rope 128 can be attached to the front surface of Windsurfing devices 36 and 46, respectively, and may be used to pull the wind sailing vessel 20 to and from the water.

Much of the technology and features of the wind sailing and Windsurfing art can be incorporated in addition to those features described in more detail above. It should be appreciated from the foregoing description that the present invention provides an improved sailing vessel which is completely portable, and versatile in that an inexperienced sailor can attain extreme maneuverability and speed not known to comparable craft in the art. The sailing vessel of the present invention provides for a greatly stabilized "Windsurfing-type" craft having a greater ease of operation and turning ability, yet requires little balance, coordination and muscular agility. Furthermore, the wind sailing vessel of the present invention is completely versatile for sailing in an assembled condition or dissociated and used as a conventional windsurfing craft. The vessel is compact and completely portable for purposes of transportation and storage. The wind sailing vessel is easy to assemble as well as disassemble and easy to manufacture.

Conventional sailing vessels with two hulls or having standard bows or pontoons have not been able to achieve the same capability as the instant invention. However, the Windsurfing devices 36 and 46 skim over the surface of the water and can actually pivot about the centerboards or keels 50 and 52, providing an ease of turning heretofore unknown in the art of catamaran sailing. Yet, the centerboards or keels 50 and 52 in combination with the rear fins 41 and 42 of Windsurfing devices 36 and 46 provide a completely stable vessel which can hold a desired course in high wind and rough water.

Although the present invention has been described in detail in reference only to present-preferred embodiment, it will be appreciated by those of ordinary skilled in the art that various modifications can be made without departing from the invention. Accordingly, the invention is limited only by the following claims.

What is claimed is:

1. A wind sailing vessel for use with a mast and sail and first and second windsurfing devices having planar undersurfaces and mast and footstrap inserts for sailing over a water surface comprising:

a platform means for joining the first and second windsurfing devices in parallel relationship wherein said platform means is dissociable from each of the windsurfing devices by fastening means parallel to the windsurfing devices in an assembled condition, said platform means further providing a centrally located mounting means for the mast and sail between outboard sides of the platform means, said fastening means comprising forward and aft plate members; and a centerboard means for providing sailing maneuverability associated with said platform means and having twin blades, said two blades substantially closer to each other than to said outboard sides of the platform means, said centerboard means being parallel to the windsurfing devices thereby providing substantial steerability yet remaining fixed and rigid while sailing, wherein the planar undersurfaces of the windsurfing devices skim over the water surface and the windsurfing devices pivot about a point defined by said centerboard means upon turning the wind sailing vessel.

2. A wind sailing vessel as claimed in claim 1, wherein said platform means has an arch shape, allowing said platform means to arch between the windsurfing devices and provides a predetermined clearance height between water surface and an underside of said platform means when the vessel is in an assembled condition and placed upon the water surface.

3. A sailing vessel as claimed in claim 2, wherein said platform means having straight rails on opposite sides and having front and rear portions, said front and rear portions of said platform means further defining elongated nose portions.

4. A wind sailing vessel as claimed in claim 1, wherein said platform means having an exterior made from fiber glass shell and filled interiorly with buoyant foam.

5. A wind sailing vessel as claimed in claim 3, wherein said centrally located mounting means defining a recessed region on an upper surface of said front portion of said platform means for engaging the mast and sail.

6. A wind sailing vessel as claimed in claim 5, wherein said twin blades of said centerboard means project downwardly from an undersurface of said platform means, said twin blades located perpendicular and extending below a plane defined by the undersurfaces of the first and second windsurfing devices, wherein said twin blades extend below the surface of the water during sailing.

7. A sailing vessel as claimed in claim 6, wherein said platform means has a predetermined clearance height of at least six inches between the undersurfaces of the first and second windsurfing devices and said underside of said platform means when in the assembled condition.

8. A sailing vessel as claimed in claim 6, wherein said undersurface of said platform means defines a plurality of longitudinal legs located inboard at each corner from said rails, said longitudinal legs having uniform length and generally even with a plane defined by a bottom surface of said rails.

9. A sailing vessel as claimed in claim 8, wherein said longitudinal legs define leg recess portions facing outwardly toward said straight rails, said straight rails defining rail recessed portions along an inboard side of said straight rails complimentary to said leg recessed portions of said longitudinal legs, wherein said longitudinal legs and said straight rails having a width sufficient to support said platform means when mounted to the first and second windsurfing devices during sailing.

10. A wind sailing vessel as claimed in claim 9, wherein said forward and aft plate members of said fastening means are laterally located at each corner of said undersurface of said platform means between said rail recessed portions and said leg recessed portions, said forward and aft plate members defining a plurality of first and second apertures; and a plurality of platform threaded insert portions located interiorly within said undersurface of said platform means and along said rail recessed portions and said leg recessed portions for receiving a plurality of plate member fastening screws, said forward and aft plate members affixed to said rail recessed portions and said leg recessed portions by aligning said first apertures to coincide with said platform threaded insert portions and said plate member fastening screws inserted through said first apertures and rotatively engaged in said platform threaded insert portions wherein said forward and aft plate members are secured against said undersurface of said platform means.

11. A wind sailing vessel as claimed in claim 10, wherein said forward plate members fasten to the first and second windsurfing devices by aligning said second apertures of said forward plate members to coincide with the mast inserts of said first and second windsurfing devices; and a thumb screw defining a threaded end inserted through said second apertures and rotatively engaged in the mast insert of the first and second windsurfing device wherein said forward plate members are secured against the first and second windsurfing devices.

12. A wind sailing vessel as claimed in claim 10, wherein said aft plate members and said rail and leg recessed portions having a stand off located therebetween and a plurality of rubber spacers located between said aft plate members and said plate member fastening screw heads;

said aft plate members fasten to the first and second windsurfing devices by aligning said second apertures of said aft plate members to coincide with the footstrap inserts of said first and second windsurfing devices; and a thumb screw defining a threaded end inserted through said second apertures and rotatively engaged in the footstrap inserts of the first and second windsurfing devices wherein said aft plate member are secured against the first and second windsurfing devices and said rubber spacers spread load forces and provide additional adjustability depending on the windsurfing devices in use.

13. A wind sailing vessel as claimed in claim 10, wherein a plurality of second plate members defining a plurality of first and second apertures fasten to the first and second windsurfing devices by aligning said first apertures of said second plate members to coincide with the footstrap inserts of the first and second windsurfing devices;

a plurality of rubber spacers located between the footstrap inserts and said aligned first apertures of said second plate members, said second apertures having first fastening screws located therein, said first fastening screws defining threaded ends opposite the footstrap inserts; and a plurality of second fastening screws defining threaded ends and inserted through said first apertures and rotatively engaged in the footstrap inserts of the first and second windsurfing devices wherein said second plate members are secured against the first and second windsurfing devices and said rubber spacers spread load forces and provide additional adjustability depending on the windsurfing devices in use;

said aft plate members fasten to said second plate members by aligning said aft plate member apertures of said aft plate members to coincide with insertion of said first fastening screws of said second plate members; and a plurality of thumb screws defining threaded inserts for rotative engagement on said threaded ends of said first fastening screws wherein said aft plate members are secured against said second plate members thereby securing said platform means to the first and second windsurfing devices.

14. A wind sailing vessel as claimed in claim 1, wherein said twin blades of said centerboard means define apertures, a cylindrical member having a diameter to be received with said apertures of said twin blades, said cylindrical member having a wheel member centrally located on said cylindrical member, a plurality of collar members located on said cylindrical member and on each side of said wheel member, wherein said cylindrical member is received in said apertures by bending said twin blades apart and inserting said cylindrical member through said apertures and said twin blades collapsing onto said collar members thereby allowing said wheel member to have rotative movement and provide for transporting the wind sailing vessel to and from the water.

15. A wind sailing vessel for use with a mast and sail and first and second windsurfing devices having planar undersurfaces and mast and footstrap inserts for sailing over a water surface comprising:

a platform means for joining the first and second windsurfing devices in parallel relationship, said platform means having straight rails on opposite sides and having front and rear portions, said front and rear portions of said platform means further defining elongated nose portions;

a plurality of fastening means located on the undersurface of said platform means, said fastening means comprising forward and aft plate members, and said platform means further providing a centrally located mounting means for the mast and sail; and a centerboard means for providing sailing maneuverability associated with said platform means and having twin blades, said twin blades substantially closer to each other than to said straight rails on opposite sides of the platform means, said twin blades of said centerboard means projected downwardly from said undersurface of said platform means, said twin blades located perpendicular and extending below a plane defined by the undersurfaces of the first and second windsurfing devices, wherein said twin blades extend below the surface of the water during sailing and the windsurfing devices pivot about a point defined by said centerboard means upon turning the windsurfing vessel.

16. A sailing vessel as claimed in claim 15, wherein said undersurface of said platform means defines a plurality of longitudinal legs located inboard at each corner from said rails, said longitudinal legs having uniform length and generally even with a plane defined by a bottom surface of said rails; and said longitudinal legs define leg recess portions facing outwardly toward said straight rails, said straight rails defining rail recessed portions along an inboard side of said straight rails complimentary to said leg recessed portions of said longitudinal legs, wherein said longitudinal legs and said straight rails having a width sufficient to support said platform means when mounted to the first and second windsurfing devices during sailing.

17. A wind sailing vessel as claimed in claim 16, wherein said forward plate members of said fastening means define a plurality of first and second apertures;

a plurality of platform threaded insert portions located interiorly within said undersurface of said platform means and along said rail recessed and leg recessed portions for receiving a plurality of plate member fastening screws;

said forward plate members affixed to said rail recessed portions and said leg recessed portions at said front portion of said platform by aligning said first apertures to coincide with said platform threaded insert portions and said plate member fastening screws inserted through said first apertures and rotatively engaged in said platform threaded insert portions;

said forward plate members fasten to the first and second windsurfing devices by aligning said second apertures of said forward plate members to coincide with the mast inserts of said first and second windsurfing devices; and a thumb screw defining a threaded end inserted through said second apertures and rotatively engaged in the mast insert of the first and second second windsurfing device wherein said forward plate members are secured against the first and second windsurfing devices.

18. A wind sailing vessel as claimed in claim 17, wherein said aft plate members of said fastening means define a plurality of first and second apertures;

a plurality of platform threaded insert portions located interiorly within and along said undersurface of said platform means and along said rail recessed and leg recessed portions for receiving a plurality of plate member fastening screws;

said aft plate members affixed to said rail recessed portions and said leg recessed portions at said rear portion of said platform means by aligning said first apertures to coincide with said platform threaded insert portions and said plate member fastening screws inserted through said first apertures and rotatively engaged in said platform threaded insert portions;

said aft plate members fasten to the first and second windsurfing devices by aligning said second apertures of said aft plate members to coincide with the footstrap inserts of said first and second windsurfing devices; and a thumb screw defining a threaded end inserted through said second apertures and rotatively engaged in the footstrap insert of the first and second windsurfing device wherein said aft plate members are secured against the first and second windsurfing devices.

19. A wind sailing vessel as claimed in claim 15, wherein a plurality of second plate members defining a plurality of first and second apertures fasten to the first and second windsurfing devices by aligning said first apertures of said second plate members to coincide with the footstrap inserts of the first and second windsurfing devices;

a plurality of rubber spacers located between the footstrap inserts and said aligned first apertures of said second plate members, said second apertures having first fastening screws located therein, said first fastening screws defining threaded ends opposite the footstrap inserts;

a plurality of second fastening screws defining threaded ends and inserted through said first apertures and rotatively engaged in the footstrap inserts of the first and second windsurfing devices wherein said second plate members are secured against the first and second windsurfing devices and said rubber spacers spread load forces and provide additional adjustability depending on the windsurfing devices in use; said aft plate members fasten to said second plate members by aligning said aft plate member apertures of said aft plate members to coincide with insertion of said first fastening screws of said second plate members; and a plurality of thumb screws defining threaded inserts for rotative engagement on said threaded ends of said first fastening screws wherein said aft plate members are secured against said second plate members thereby securing said platform means to the first and second windsurfing devices.

20. A wind sailing vessel as claimed in claim 15, wherein said twin blades of said centerboard means define apertures, a cylindrical member having a diameter to be received with said apertures of said twin blades, said cylindrical member having a wheel member centrally located on said cylindrical member, a plurality of collar members located on said cylindrical member and on each side of said wheel member, wherein said cylindrical member is received in said apertures by bending said twin blades apart and inserting said cylindrical member ends through said apertures and said twin blades collapsing onto said collar members thereby allowing said wheel member to have rotative movement and provide for transporting the wind sailing vessel to and from the water.

21. A surf-sailing craft comprising:

(a) a first windsurfing device having a first undersurface defining a first fin and mast and footstrap inserts;

(b) a second windsurfing device having a second undersurface defining a second fin and mast and footstrap inserts;

(c) a platform means for joining the first and second windsurfing devices in parallel relationship, said platform means having straight rails on opposite sides and having front and rear portions, said front and rear portions of said platform means further defining elongated nose portions, and fastening means located on the undersurface of said platform means, said fastening means comprising forward and aft plate members, and said platform means further providing a centrally located mounting means for the mast and sail between outboard sides of the platform means; and (d) a centerboard means for providing sailing maneuverability associated with said platform means and having twin blades, said twin blades substantially closer to each other than to said straight rails on opposite sides of the platform means, said twin blades of said centerboard means projected downwardly from said undersurface of said platform means, said twin blades located perpendicular and extending below a plane defined by the undersurfaces of the first and second windsurfing devices, wherein said twin blades extend below the surface of the water during sailing and the windsurfing devices pivot about a point defined by said centerboard means upon turning the windsurfing vessel.

22. A wind sailing vessel as claimed in claim 21, wherein said twin blades of said centerboard means define apertures, a cylindrical member having a diameter to be received with said apertures of said twin blades, said cylindrical member having a wheel member centrally located on said cylindrical member, a plurality of collar members located on said cylindrical member and on each side of said wheel member, wherein said cylindrical member is received in said apertures by bending said twin blades apart and inserting said cylindrical member ends through said apertures and said twin blades collapsing onto said collar members thereby allowing said wheel member to have rotative movement and provide for transporting the wind sailing vessel to and from the water.

23. A surf sailing craft as claimed in claim 21, wherein said first and second fins of said first and second windsurfing devices defining first and second apertures;

a cylindrical member having a diameter to be received with said first and second apertures of said first and second fins, said cylindrical member having first and second wheel members centrally located on said cylindrical member, and an inside collar located on said cylindrical member between said first and second wheel members;

a plurality of collar members located on said cylindrical member and on each side of said first and second wheel members, wherein said cylindrical member is received in said first and second apertures by bending said first and second fins apart and inserting said cylindrical member ends through said first and second apertures and said first and second fins collapsing onto said collar members thereby allowing said first and second wheel members to have rotative movement and provide for transporting the wind sailing vessel to and from the water.

* * * * *